United States Patent [19]

Khalid et al.

[11] Patent Number: 4,921,590

[45] Date of Patent: May 1, 1990

[54] PRODUCTION OF METAL FOIL HAVING IMPROVED WEIGHT DISTRIBUTION ACROSS THE WIDTH OF THE FOIL

[75] Inventors: Joseph M. Khalid, East Windsor; David G. Plagge, Mount Holly, both of N.J.

[73] Assignee: Yates Industries, Inc., Bordentown, N.J.

[21] Appl. No.: 319,296

[22] Filed: Mar. 27, 1989

[51] Int. Cl.[5] ..... C25A 17/10

[52] U.S. Cl. ..... 204/216

[58] Field of Search ..... 204/216

[56] References Cited

U.S. PATENT DOCUMENTS 3,461,046 8/1969 Clancy ..... 204/216

3,674,656 7/1972 Yates ..... 204/216

3,767,537 10/1973 Selker ..... 204/216

*Primary Examiner*—T. M. Tufariello

*Attorney, Agent, or Firm*—William T. McClain; Michael J. Femal

[57] ABSTRACT

A drum cathode for the electrolytic production of metal foil having a current collection yoke of high current carrying capacity which electrically connects each end of the drum to a current collecting hub in the center of the drum. The current collecting hub is positioned on an electrically conducting sleeve over the drum's shaft for conducting the collected current to the exterior of the drum. This permits the electric current to flow through the top sheet of the drum symmetrically to enable the production of foil having a more uniform and symmetrical weight distribution across the width of the drums.

8 Claims, 4 Drawing Sheets a. TOP CYLINDER RESISTANCE b. ELECTROLYTE SOLUTION RESISTANCE

PRODUCTION OF METAL FOIL HAVING IMPROVED WEIGHT DISTRIBUTION ACROSS THE WIDTH OF THE FOIL

FIELD OF INVENTION

This invention relates to the electrolytic production of metal foil. More particularly, this invention relates to a drum cathode for use in the production of copper foil by the electrodeposition of copper on the drum from an electrolyte.

BACKGROUND OF THE INVENTION

With the growth of the electronics industries over the last two decades, the use of electrodeposited copper foil in integrated circuit boards, which are used in computers and other electronic products, has assumed increasing importance.

The electrodeposition of a metal on a rotating drum cathode from a metal-containing electrolyte to produce a thin metal foil on the surface of the drum has been in use for about 50 years. For example, U.S. Pat. No. 3,674,656 discloses an electrochemical process for the manufacture of copper foil for printed circuit boards which are made by laminating copper foil to a polymeric insulating base material. The process uses a drum cathode which rotates partially immersed in a body of copper sulfate electrolyte adjacent a pair of curved anodes. Typically, the anodes, which are insoluble, are made of lead, lead antimony, platinized titanium or oxides of iridium and ruthenium. The top, or outer surface of the drum is typically made of stainless steel, titanium, or stainless steel plated with chromium.

As the drum rotates in the electrolyte, an electrodeposit of copper forms on the outer surface of the drum and, as the latter leaves the electrolyte, the electrodeposited copper is stripped from the surface of the rotating drum in the form of a thin foil. In such a process, the amperage used directly determines the amount of copper electrodeposited on the cathode.

A drum cathode, the sole function of which is the production of copper or other foil by electodeposition, should have the following performance features:

1. Good corrosion resistance especially on the plating surface;
2. Good surface finish with good foil adhesion and stripping characteristics;
3. Capable of carrying high electric current (for high ouput);
4. Efficient in making porosity-free and defect-free foil;
5. Able to produce uniform thickness of foil all across the drum width, also referred to as web weight distribution (WWD);
6. Low labor and low cost maintenance; and
7. The usual requirements of availability of components, machinability, non-toxicity, cost effectivness, etc.

It has previously been recognized that, in order to achieve requirement No. 5 above, it is desirable to have the electric current uniformly distributed over the surface of the drum cathode. For example, in U.S. Pat. No. 3,767,537 discloses the desirability of evenly distributing the electric current across a titanium drum and cites French patent No. 1,540,378 which proposes the use of a lead lining beneath the titanium cylinder to produce a "uniform current density."

U.S. Pat. No. 3,461,046 also discloses the need for improved uniformity of gauge across the width of the cathode drum on which it is produced. The above patents disclose the use of a soft sheet of lead held against the inner surface of the titanium top shell by thermal expansion to achieve better current distribution across the drum. It was believed that, because of its greater coefficient of thermal expansion, the soft and ductile lead sheet conforms during use to the inner surface of the harder top shell. Analysis has shown, however, that such non-permanent contacts which are produced and maintained by mechanical pressure are unstable and unreliable as current conduction means. Consequently, their resistance is neither stable nor uniform, with the result that uniform distribution of current across the drum is not actually achieved during use of the drum.

Referring to FIG. 1, a widely used process for the electrolytic production of copper foil involves the use of a drum cathode 10 which rotates partially immersed in an aqueous solution of copper sulfate electrolyte 12 adjacent a pair of curved insoluble anodes 14. As the drum 10 rotates in the electrolyte 12, an electrodeposit of copper forms on the drum cathode's outer surface and, as the latter leaves the electrolyte, the electrodeposited copper is stripped from the surface of the rotating drum in the form of a thin foil 16 which is then edge-trimmed and wrapped around a take-up roll 18.

The drum 10, electrolyte 12 and anodes 14 are held in a tank 20 and, typically, fresh electrolyte feed from a dissolving tank is fed into tank 20 through a series of openings in feed conduit 22 located near the bottom of tank 20 adjacent the gap between the spaced-apart anodes 14 and beneath drum cathode 10. Electric current of the desired amperage is provided by an appropriate source, for example, the positive terminal of a DC rectifer, and flows from buss bars 24 to anodes 14 through electrolyte 12 in the space between anodes 14 and the outer surface of drum cathode 10 where copper from the electrolyte 12 is deposited on the outer surface of drum 10 in the form of a thin film. The concentration of the copper in electrolyte 12 and the amperage flowing through the system determine the amount of copper deposited on the surface of drum 10, and hence for a given drum speed, the thickness of the electrodeposited film.

Referring to the conventional drum shown in FIG. 2, the electric current passes from the electrolyte solution through top cylinder 26 to a base cylinder 28 and to each of the side sheets 30 positioned near the outer ends of the base cylinder 28 and circumferentially welded thereto. Typically, each of the side sheets comprises a stainless steel side sheet 32, with a copper side sheet 34 placed on the inner surface thereof for enhanced electrical conductivity. The electric current then flows through the copper side sheet to shaft 36 which rotatably supports drum 10 through a copper hub 38 and a shaft sleeve 42. The copper sleeve 42 is fitted over shaft 36 and extends longitudinally on shaft 36 across the interior of drum 10 where it is welded to each of copper side sheets 34 and extends to the exterior of the drum on the collection side thereof. Copper sleeve 42 conducts the electric current to a brush 44, or similar arrangement, which is in contact with a contact block 46, as shown in FIG. 1. Electric current is then passed from the contact block to buss bars 48 and to the negative terminal of the DC rectifier.

In the conventional drum design shown in FIG. 2, the electric current passing from the electrolyte through the drum's outer surface or top cylinder 26, is carried from each end of the drum, through the side sheets 30 of the drum, to approximately the axial center, or rotational axis, of the drum. There, the current is collected by a copper sleeve 42 over the shaft 36 and passed from the drum on its collection side where it is collected and returned to the negative terminal of the power supply source. On the side of the drum opposite from the current collection side (the drive side), the shaft is connected, through gearing, to an electric motor used to rotate the drum.

Copper foil produced on drum cathodes of the above-described type has been found to have an undesirable weight distribution across the width of the foil, e.g., the thickness of the copper foil on the current collection side of the drum is significantly greater than the thickness on the drive side of the drum, and there are significant variances in the thickness of the foil deposited on either side of the drum's transverse plane of symmetry. This is shown in FIG. 3, which is a plot, for a typical run of foil produced on a conventional drum, showing the deviation from the mean thickness of the foil at points across the width of the drum. The ordinate is normalized as a ratio of foil thickness to mean thickness across the full width of the web, and the abscissa is the drum width. As a figure of merit for a drum's WWD performance, with other machine parameters being held constant, we took the relative deviation or the ratio of the standard deviation to the mean and multiplied it by 100 to express it in %.

As was earlier indicated, there are temporary and time-consuming ways to make selective compensations and adjustments to rectify a bad WWD. For unadjusted production runs, we have seen relative deviations ranging from a fraction of 1% to about 6%. Our experience has been that in order for a roll of foil to handle and process well through windup and unwind equipment, and, in order for such foil to resist wrinkling, the foil thickness needs to be symmetrical and uniform with a WWD relative deviation of a fraction of 1%. This is particularly true of the thinner foil gauges.

It will be seen from FIG. 2 that the electric current collected on the drive end 36*a* of the drum must travel through a larger, higher resistance path to reach the collection end 36*b* of the drum than the electric current collected on the collection side 36*b* of the drum. Consequently, the magnitude of the current collected from the drive end of the drum is decreased relative to that collected from the collection end. The flow of current through the drive end of the top sheet 26 is decreased relative to that through the top sheet on the collection side. As a result, the thickness of the copper electrodeposited on the drive end of the drum will be less than that deposited on the collection end. This phenomenon is evidenced in the plot shown in FIG. 3 which illustrates that the deviation from the mean foil thickness on the drive end of the drum is noticeably less than the deviation from the mean foil thickness of the foil deposited on the collection end of the drum.

We have now overcome the problems of such prior drum cathodes and have developed the present invention which enables the production of foil having a substantially uniform web weight distribution across the width of the drum. The present invention is based upon the following analysis:

First, a drum design should provide an electrical resistance distribution that is uniform and symmetrical both circumferentially and about a vertical plane that dissects the drum into two identical halves. This plane of symmetry is shown as a dotted line 11 going through the vertical center the drum shown in FIG. 2.

Secondly, the electrical resistance distribution of the electrolyte solution in the anode-cathode gap and the anode should be also uniform and symmetrical about the same plane. Since the present invention is concerned with the cathode drum, rather than the plating machine, the following discussion will concentrate on the first of the above features.

If the resistance is uniform around the circumference of the drum, the condition of symmetry also requires that for every current carrying element to the right of the transverse center plane, i.e. the plane of symmetry 11, there is a like and equidistant element to the left of that plane with an identical resistance value. For this latter condition to be met at all times, clearly the resistance of every element involved must be stable; this precludes current carrying mechanical connections.

Imagine dividing the drum surface into a grid of a large number of surface elements of equal areas each carrying a small current element. The condition of symmetry of electrical resistance requires that for every current carrying element to the right of the transverse center plane, i.e., the plane of symmetry 11, there is a like and equidistant element to the left of that plane with an identical resistance value. For this condition to be met at all times, clearly the resistance of every element involved must be stable; this precludes current carrying mechanical connections.

The requirement of uniformity across the width of the drum dictates that the resistance of any element does not vary significantly from the mean resistance of all elements. The symmetry requirement derives from practical experience. A roll of foil handles better, winds tighter and tracks through web handling equipment without wrinkling if the web thickness does not vary much from side to side.

The condition of uniformity of electrical resistance is derived as follows. The voltage drop from the anode through the cathode is constant for a given set of operating conditions: i.e., current, cathode-anode gap, acid concentration, copper concentration, temperature and solution flow rate. This voltage V is related to each element , its current, $I_n$, its voltage, $V_n$, and its resistance, $R_n$, by Ohm's law (all elements being in parallel).

$$V = V_n = I_n R_n \quad (1)$$

Since the weight of deposited copper is directly proportional to the current In, it follows that if one wishes to have a uniform web weight distribution, then one must assure that all current elements for the same unit area of foil are equal. As can be seen from eq. (1), this condition is fulfilled if the resistance of each of these elements is the same.

Taking a closer look at $R_n$ and its makeup, we see that it basically comprises two components, the resistance of the nth element of the drum, $R_{nd}$, and the resistance of the nth element of solution in the anode-cathode gap, $R_{ng}$, so that:

$$R_n = R_{nd} + R_{ng} \quad (2)$$

Of these two components $R_{ng}$ is the larger one. For example in the drum shown in FIG. 6, $R_{ng}$ is typically 80%–90% of $R_n$ with $R_{nd}$ accounting for 10–20% of $R_n$. With these proportions it first appears that $R_{nd}$ should be disregarded in order to fine-tune $R_n$ exclusively by changing $R_{ng}$. While in principle this is possible, in practice it is not advisable because it is a time-consuming, temporary and expensive way of achieving uniformity. This can be more clearly seen by examining Table 1 below which gives the resistivity, r, for various conductors that make up the various elements of resistance $R_n$ in a typical foil operation

TABLE I

| Conductor | Micro-ohm cm |
|---|---|
| copper | 1.7 |
| lead | 21 |
| stainless steel | 75–79 |
| titanium, grade I | 54 |
| copper sulfate solution, typical (10% $H_2SO_4$) | 3,000,000 |

The resistance of a small element of any conductor is given by $$R = r\ 1/A \quad (2)$$

where:

R = the resistance of the element r = the resistivity of the element

1 = the length of the element

A = the cross section area of the element

Table I clearly shows the resistivity of the solution is several orders of magnitude larger than that of any metallic conductor in the system. Further, one can see by looking at eq. (2) that a small adjustment in R is difficult to make. This is because an adjustment to R is made by changing either 1 or A, or both, thereby changing the ratio of 1/A; but a small change in 1/A gets multiplied by 3,000,000 to produce a very large change in R. Hence, changing the ratio 1/A is a coarse rather than a fine tuning process.

Since the drum resistance is small compared to solution resistance, it is not advisable to design the drum with asymmetric resistance and then try to compensate by making changes in the resistance of the gap. The merit of this argument gains more weight when one realizes that adjustments in the cathode anode gap need to be made to assure gap resistance symmetry. This task by itself is difficult enough and one does not need to make it even more complex by another small but sensitive set of adjustments to achieve the drum resistance symmetry. With the foregoing considerations in mind, we became aware of the significance of choosing among three basic drum designs. Each design involves a different current path within the drum and consequently a different web weight distribution pattern.

The first such drum design is represented by FIG. 6 where current elements from the solution enter the drum top cylinder surface and bend to flow across the thickness of the top cylinder to the circumferential welds, to the copper discs 58, to the cylinders 56, to the copper hub 50 and out through the copper sleeve 60 to the current collection system.

The second such design would be similar to the drum shown in FIG. 2, but with two modifications: (1) instead of the two copper side discs 34, there would be a large number of discs closely spaced inside the drum and all parallel to plates 34; (2) Top shell 26 and base shell 28 would be replaced by one thick shell only and each disc would be connected at its periphery to the inside surface of the top shell and at the center to the shaft/sleeve assembly by circumferential 360 degree welds.

The third such design would be a hybrid of the first add second designs. For example, fewer interior discs may be used or the discs themselves could be replaced with spiders, cogs or even bunches of cable. An example of the third design is shown in FIG. 2 of U.S. Pat. No. 3,461,046.

In the second design current elements from the solution would enter the top surface of the drum, travel straight down through the parallel discs or the like into a shaft/sleeve assembly and from there into a current collection system.

When considering the basic first two designs from the point of view of uniform and symmetrical web weight distribution, and having chosen a titanium top cylinder supported by an underdrum, the first design is superior to the second design on several counts.

First, welds connecting the titanium shell to the interior discs of the second design would change the local titanium microstructure from the desired alpha phase t the undersirable and more corrosion-prone Beta phase. Second, the first design is simpler, more economical, and permits an easy replacement of a thinner lower cost titanium top shell and an easy reuse of the underdrum. Third, the first design offers the opportunity to compensate for the lack of uniform resistance of the solution in the cathode-anode gap. This can be seen in FIG. 7, wherein curves a and b depict the theoretical electrical resistance, at points across the drum's width, of the top cylinder and the electrolyte solution, respectively, when using the drum shown in FIG. 6. When curees a and b are added there is produced a symmetric sum, and even though b is substantially larger than a, the uniformity of resistance across the width of the drum is more aided than compromised.

As previously noted above, the third drum design does not actually provide a uniform distribution of electric current across the width of the drum.

Therefore, a principal object of the present invention is to provide a drum cathode for use in the electrolytic production of metal foil, such as copper foil, which enables a more uniform and symmetrical weight distribution across the width of the foil produced on the drum cathode. Another object of the invention is such a drum cathode wherein there is a more symmetrical flow of electric current through the surface of the drum from one end to the other. Other objects and advantages of the present invention will become apparent from the following description of preferred embodiments of the present invention and the use of the same.

SUMMARY OF THE INVENTION

To achieve the objects, and in accordance with the purpose of, the present invention, as embodied and broadly described herein, there is provided a rotatable drum cathode comprising a cylindrical metal drum having two ends and an outer surface on which the foil is deposited, the drum having a rotational axis; current collection means electrically connected to the outer surface for collection of electric current from said outer surface substantially symmetrically on either side of the transverse center-plane of said drum and conducting the collected electrical current to approximately the rotational axis; and current conductor means having an end exterior of said drum and extending from the interior of the drum along the rotational axis to the exterior of the drum and being electrically connected to the current collection means; the drum, the current collection means and the current conductor means being adapted to permit electric current to flow from the outer surface substantially uniformly and symmetrically on either side of the transverse centerplane during use of the drum cathode.

In a preferred embodiment of the present invention the drum includes a pair of circular side sheets, each attached to opposite ends of the drum and in electrical contact therewith. There is also included a shaft through the center of the side sheets, and the current conductor means is a metal sleeve of high electrical conductivity covering the shaft and extending from the central portion of the shaft through one of the side sheets to the exterior of the drum cathode. Further, the current collecting means is formed of a metal having a high electrical conductivity relative to that of the side sheets, and the resistance path from the outer surface of the drum through the current collection means to the exterior of the drum is less than that through the side sheets to the exterior of the drum. Preferably, the current collecting means includes a yoke and a hub (both are hereinafter described), the hub is positioned on the sleeve in the central portion of the drum's interior, and the yoke comprises an electrical conductor connected to and extending from the hub to the outer surface adjacent the side sheets for symmetrically collecting electric current passed through the outer surface of the drum cathode and conducting the collected electric current to the axial center of the drum cathode.

Additional objects and advantages of the present invention will be set forth in part in the description which follows, and in part will be obvious from the description or may be learned by practice of the present invention. The objects and advantages of the invention may be realized and attained by means of the instrumentalities and combinations particularly pointed out in the appended claims.

DESCRIPTION OF PREFERRED EMBODIMENTS OF THE INVENTION

Reference will now be made in more detail to the present preferred embodiments of the invention, examples of which are illustrated in the accompanying drawings.

After experimenting with various methods of obtaining a more symmetrical and uniform foil thickness across the width of the foil produced, we arrived at a practical means for symmetrically collecting the electric current passing through the top sheet and base sheet of a drum cathode which permits foil to be produced having a symmetrical and uniform weight distribution across its width.

Figure 4:
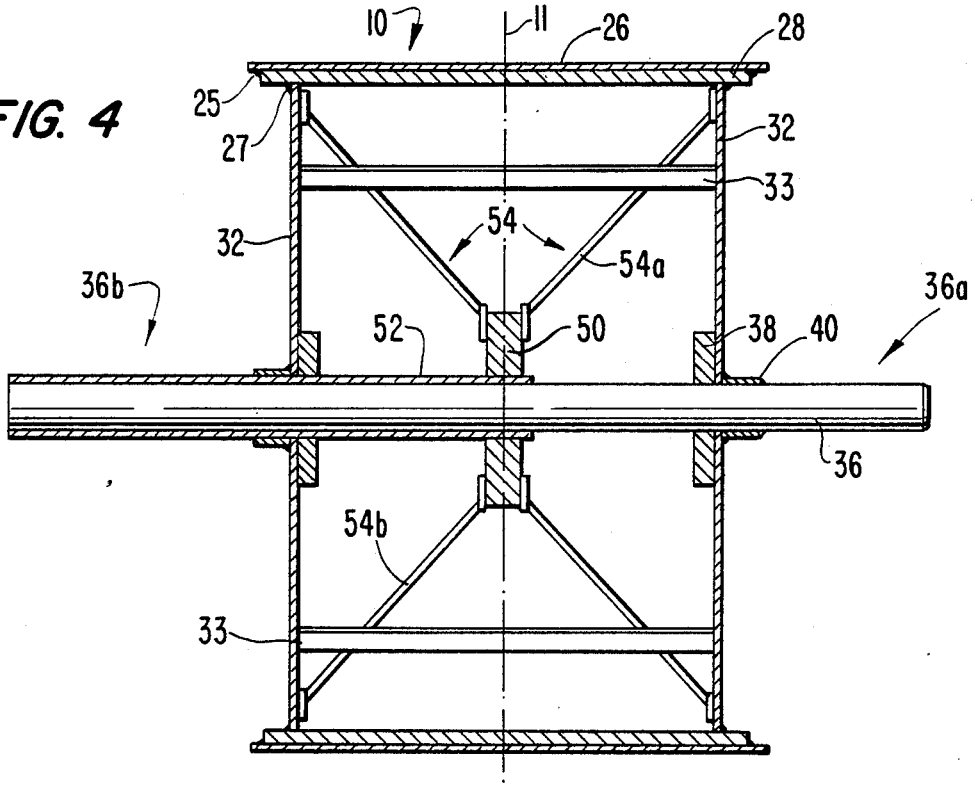
FIG. 4 is a front elevation, in section, of a drum cathode in accordance with one embodiment of the present invention.

A first embodiment of such a rotatable drum cathode is shown in FIG. 4 wherein a stainless steel base sheet 28, a top sheet 26 of titanium and stainless steel side sheets 32 are assembled as described hereinabove. Internal bracing 33 may be used, if desired, to provide the necessary rigidity to the drum.

A current collection means is electrically connected to the top sheet, or outer surface of the drum, for collecting electric current from the outer surface substantially symmetrically and uniformly on either side of the transverse centerplane of the drum and conducting the collected current to approximately the rotational axis of the drum. The current collection means includes an electrically conducting yoke and hub. The circular current collecting hub 50, which is made of copper, is positioned in substantially the transverse centerplane of the drum and welded to a current conductor means, such as copper shaft sleeve 52 which extends from substantially the transverse centerplane of the drum over shaft 36 through the side sheet 32 on the collection end **36*b* of the drum where it is connected by a brush or the like to a contact block (not shown) to permit return of the electric current to the negative terminal of the power source (not shown). The current collecting yoke 54, comprised of two copper conic sections 54*a* and 54*b*, the small end of each being welded to one side of the current collecting hub 50 and the large ends each being welded to opposite side sheets 32, which conduct the electric current from the base sheet to the current collecting hub 50. Such arrangement of the current collecting hub 50 and the current collecting yoke 54 permits the electric current to be collected from the outer surface of the drum from each end of the base sheet so as to meet equal resistances from the outer surface of the drum to the collection side 36*b* of the drum. Thus, the resistance to the current flowing from both ends of the drum is equal. This results in electric current of equal amperage flowing from each end of the base sheet and top sheet to the hub 50** from which the current flows the exterior of the drum. Thus, the current flowing through the top sheet is substantially symmetrical on either side of the transverse centerplane of the drum.

Figure 1:
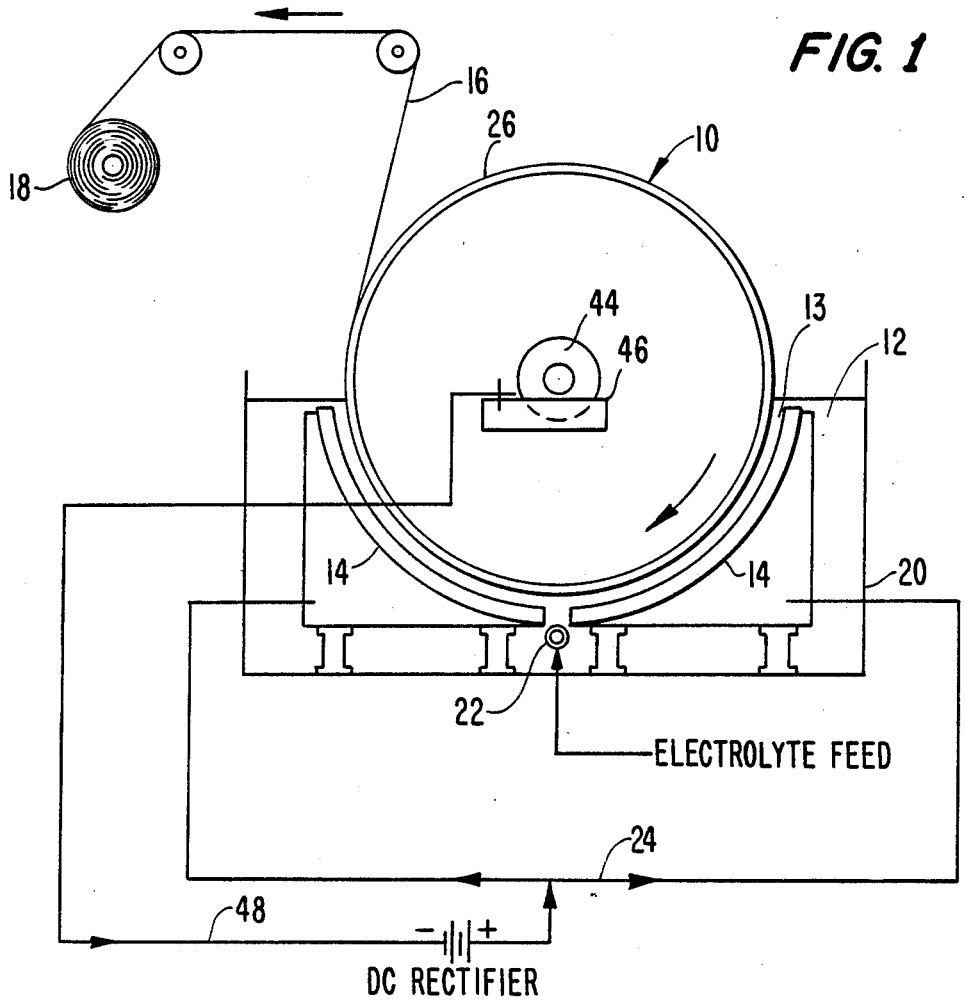
FIG. 1 is a schematic end view of conventional apparatus for producing metal foil by electrodeposition on a drum cathode.
Figure 2:
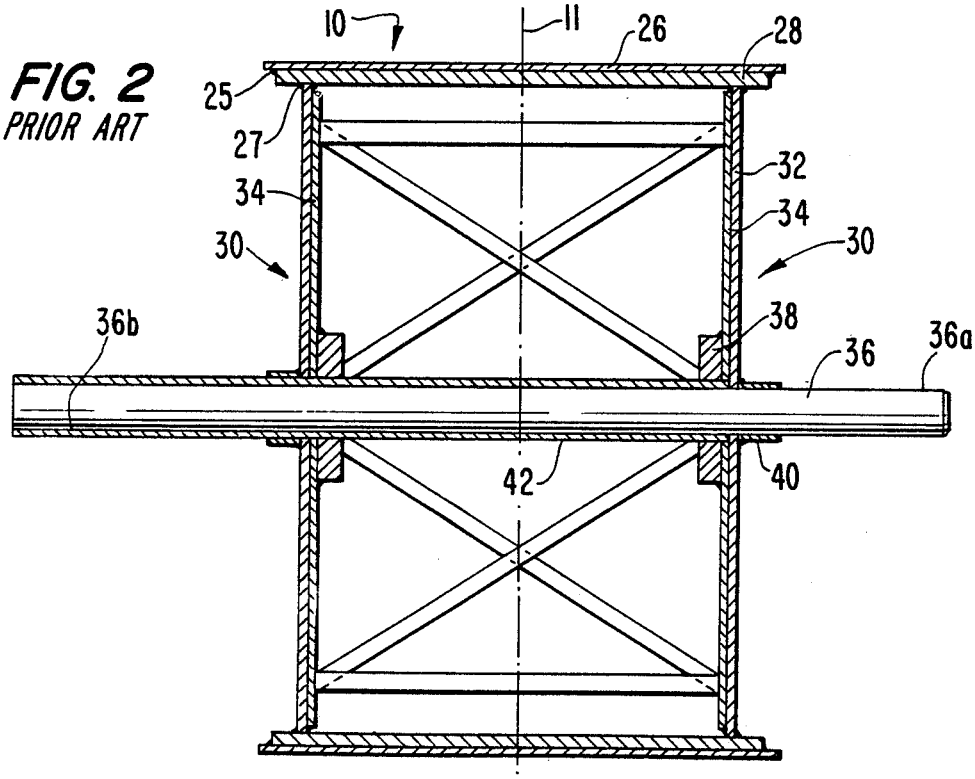
FIG. 2 PRIOR ART
FIG. 2 is a front elevation, in section, of a conventional drum cathode employed in the apparatus of FIG. 1.
Figure 3:
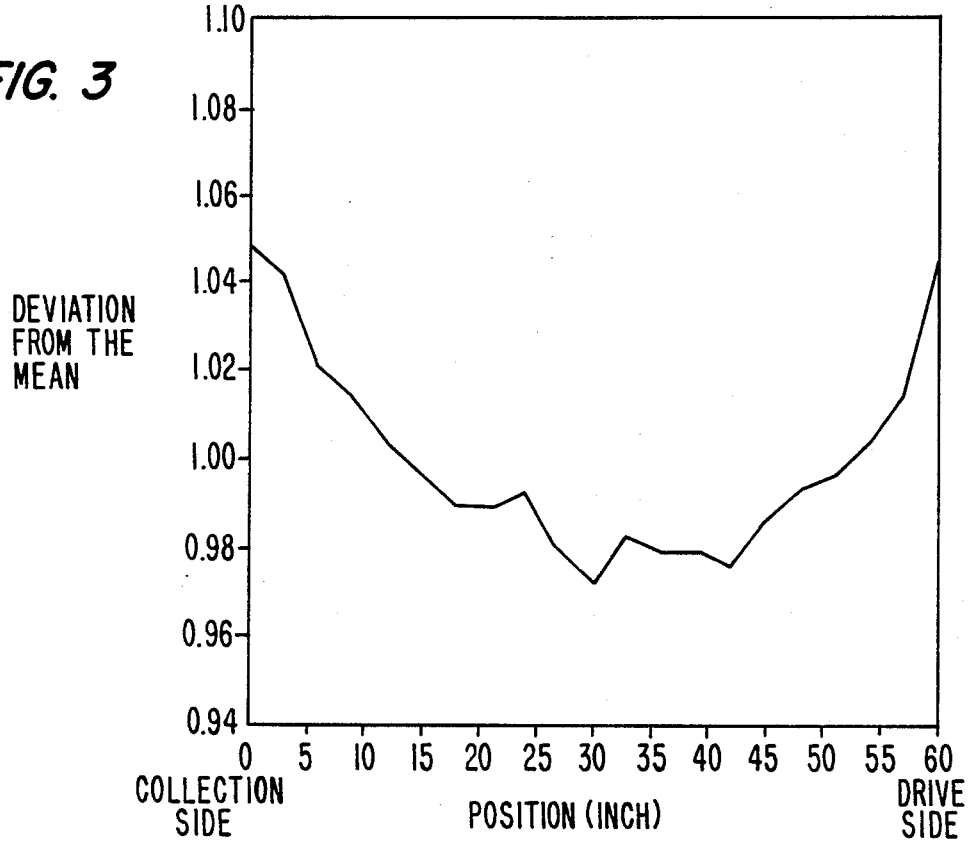
FIG. 3 is a plot of deviations from the mean foil thickness at positions across the width of foil normally produced on the drum cathode of FIG. 2.
Figure 5:
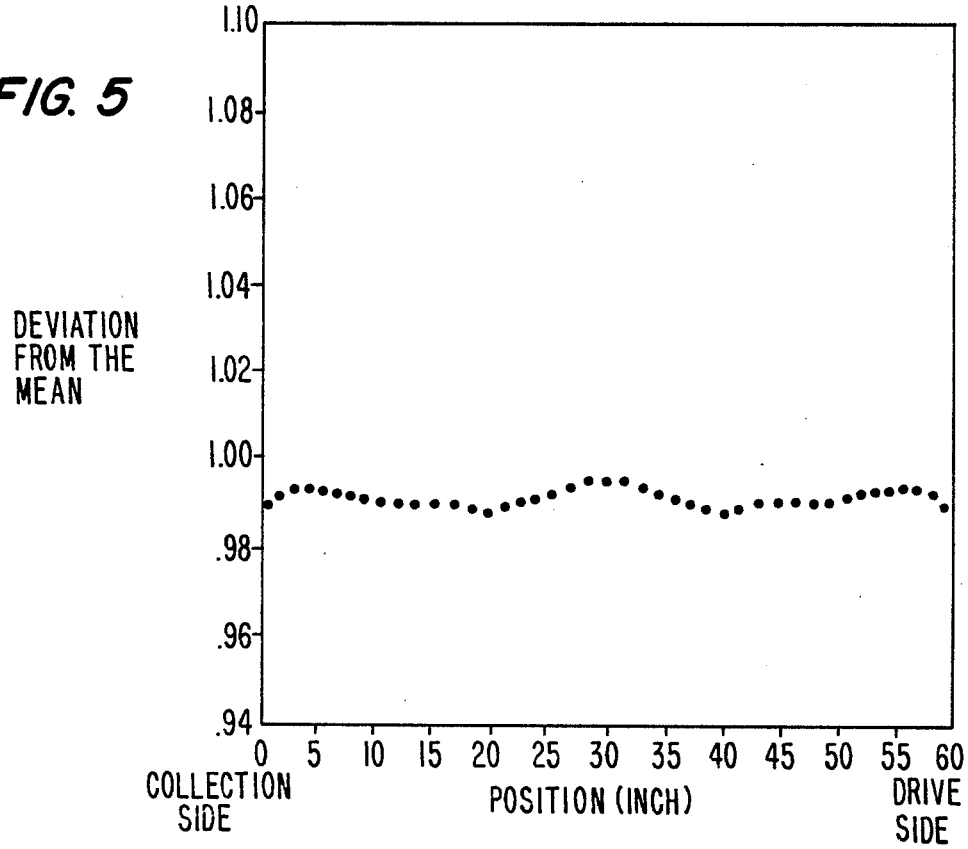
FIG. 5 is a plot of deviations from the mean foil thickness at positions across the width of the foil produced using the drum of FIG. 4.

When producing copper foil on the drum shown in FIG. 4, as shown in FIG. 5, the mean deviation of foil thickness on either side of the transverse center line of the drum is substantially equal and there is produced a foil having a more uniform and symmetrical weight distribution across the width of the foil. The relative deviation for this foil was determined to be a fraction of 1% with no special adjustments.

Figure 6:
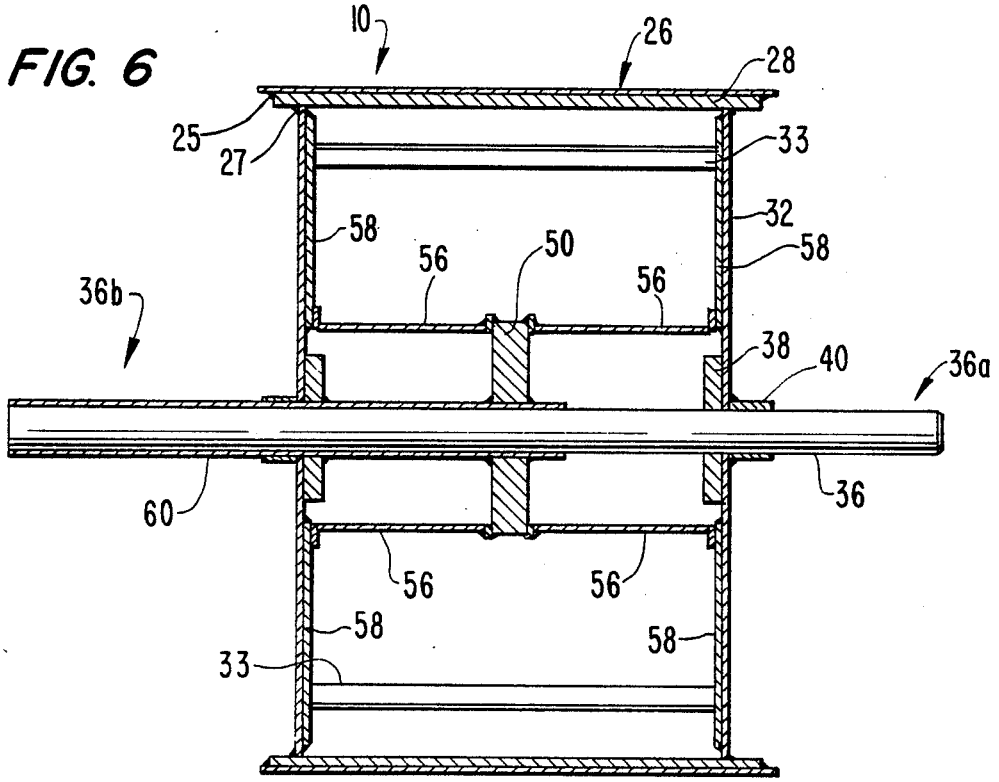
FIG. 6 is a front elevation, in section, of a drum cathode in accordance with a second embodiment of the present invention.
Figure 7:
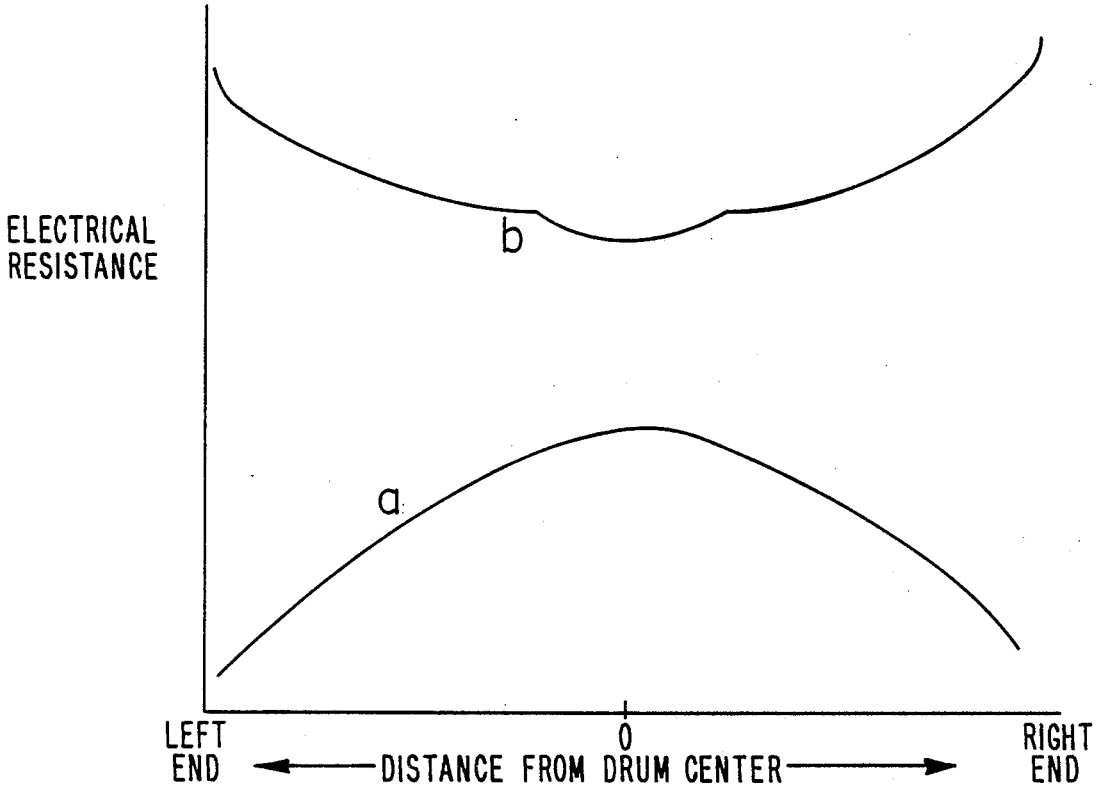
FIG. 7 is a plot of the theoretical electrical resistance, at points across the width of the drum of FIG. 6, of the electrolyte solution and the outer surface of the drum.

FIG. 6 illustrates a second embodiment of the present invention wherein each of the two cones of FIG. 4 is replaced with a side plate 58 on the interior of and welded to a side sheet 32 and two copper current collection cylinders 56, the latter being placed over and coaxial with the shaft 36. The cylinders 56 are circumferentially welded at one end to the side plates 58, and at the other end they are welded to the central hub 50. Both the side plates 58 and the cylinders 56 are made of copper or a like high conductivity material. The central hub 50 is also made of copper or a like high conductivity alloy and is positioned at substantially the transverse center of the drum 10.

As before, hub 50 is in electrical contact with a copper sleeve 60 over the left portion of shaft 36 and extending from the central portion of the drum through the side sheet 32 on the collection side 36*b* of the drum for conducting electric current from the drum. The current collection cylinders 56, together with the copper side sheets, form the electrically conducting yoke for transmitting the electric current flowing through the top sheet and base sheet to the current conducting hub in the central part of the drum from where the electric current is passed from the drum and returned to the negative terminal of the power supply source. In this manner, the electric current passing through the top sheet and base sheet flows symmetrically from each of the left-hand side and the right-hand side of the drum so that copper electrodeposited on the surface of the top cylinder has a more symmetrical and even weight distribution on each of the drive side 36*a* and the current collection side 36*b* of the transverse centerplane of the drum.

It will be apparent to those skilled in the ar that various modifications and variations can be made in the drum cathode of the present invention without departing from the spirit or scope of the invention. For example, a series of evenly-spaced tubes or rods may be used in lieu of the solid collection cones or cylinders described above in connection with the first and second embodiments or a series of spaced-apart rods may be used in conjunction with or in lieu of the copper side sheets described above in connection with the second embodiment of the invention. Thus, it is intended that the present invention cover such modifications and variations of the invention provided they come within the scope of the appended claims and their equivalents.

What is claimed is:

1. A drum cathode for use in the .electrolytic production of metal foil comprising:

(a) a rotatable cylindrical metal drum having an outer surface on which said foil is deposited, said drum having a rotational axis;

(b) current collection means electrically connected to said outer surface for collecting electric current from said outer surface substantially symmetrically on either side of the transverse centerplane of said drum and conducting the collected electric current to approximately said rotational axis; and (c) current conductor means having an end exterior of said drum and extending from the interior of said drum along said rotational axis to the exterior of said drum and being electrically connected to said current collection means;

(d) said drum, said current collection means and said current conductor means being adapted to permit electric current to flow from said outer surface, during use of said drum cathode, substantially uniformly and symmetrically on either side of said transverse centerplane.

2. The drum cathode of claim 1, wherein said current collection means includes an electrically conducting yoke electrically connected at a first end thereof to said outer surface and an electrically conducting hub adjacent said rotational axis and positioned at substantially the transverse centerplane of said drum, said yoke extending radially from said outer surface to said hub and being electrically connected at a second end thereof to said hub.

3. The drum cathode of claim 2, further including a pair of circular side sheets, each attached to opposite ends of said cylindrical drum and in electrical contact therewith, and a shaft through the center of said side sheets, about which said drum is rotatable, and wherein said current conductor means is a metal sleeve of high electrical conductivity covering said shaft and extending from the central portion of said shaft through one of said side sheets.

4. The drum cathode of claim 3, wherein said hub is positioned on said sleeve in the central portion of said drum.

5. The drum cathode of claim 4, wherein said yoke comprises a pair of conically-shaped conductors connected at their small ends to said hub and at their large ends to opposite of said side sheets adjacent the periphery thereof.

6. The drum cathode of claim 4, wherein said yoke comprises a plurality of cylindrical conductors coaxial with said shaft connected at their inner ends to said hub and at their outer ends to opposite of said side sheets.

7. The drum cathode of claim 2, wherein said current collecting yoke is formed of a metal having a high electrical conductivity.

8. The drum cathode of claim 3, wherein the electric resistance path from said outer surface through said yoke to said exterior of the drum is less than the electrical resistance path from said outer surface through said side sheets to the exterior of the drum.

* * * * *